US007198579B2

(12) United States Patent
Moss et al.

(10) Patent No.: US 7,198,579 B2
(45) **Date of Patent: *Apr. 3, 2007**

(54) BALL HITTING PRACTICE APPARATUS

(75) Inventors: Robert A Moss, New Canaan, CT (US); Hawthon Smith, South Norwalk, CT (US); Gediminas Campe, Newtown, CT (US)

(73) Assignee: Solid Contact Baseball, Inc., New Canaan, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/045,008

(22) Filed: Jan. 26, 2005

(65) Prior Publication Data

US 2005/0288127 A1 Dec. 29, 2005

Related U.S. Application Data

(63) Continuation of application No. 10/804,251, filed on Mar. 19, 2004, now abandoned, which is a continuation of application No. 09/627,146, filed on Jul. 27, 2000, now Pat. No. 6,790,150.

(60) Provisional application No. 60/147,747, filed on Aug. 6, 1999.

(51) Int. Cl.
*A63B 69/00* (2006.01)

(52) U.S. Cl. ..... 473/430; 473/423

(58) Field of Classification Search ..... 473/430, 473/415, 423, 418

See application file for complete search history.

(56) References Cited

U.S. PATENT DOCUMENTS 1,240,198 A 9/1917 Guthrie et al.
2,219,732 A 10/1940 Armstrong
2,323,624 A 7/1943 Schall
2,598,618 A 5/1952 St. Louis
3,310,306 A 3/1967 Burt
3,442,510 A 5/1969 Sorensen
3,454,275 A 7/1969 Pontone
3,529,823 A 9/1970 Garver
3,623,725 A 11/1971 Setten
3,716,235 A 2/1973 Yerkie
3,861,679 A * 1/1975 Culpepper ..... 473/429
3,893,669 A 7/1975 Myers
3,934,878 A * 1/1976 Haber ..... 473/575
4,079,934 A 3/1978 Nixon (Continued)

FOREIGN PATENT DOCUMENTS

GB 175926 3/1922

(Continued)

*Primary Examiner*—Eugene Kim
*Assistant Examiner*—M. Chambers
(74) *Attorney, Agent, or Firm*—Fish & Neave IP Group of Ropes & Gray LLP; James A. Leiz

(57) ABSTRACT

A ball hitting practice apparatus for use by a hitter is provided. The ball hitting practice apparatus includes a substantially rigid member having a first end and a second end, a hinge capable of suspension from a frame and attached near the first end of the rigid member such that the rigid member rotates about a substantially horizontal axis, and a ball mounting assembly suspended from the second end of the rigid member. Methods for using and making the ball hitting practice are also provided.

6 Claims, 13 Drawing Sheets

U.S. PATENT DOCUMENTS 4,191,372 A * 3/1980 Keller ..... 473/418
4,216,960 A 8/1980 Nicholls
4,496,156 A 1/1985 Centafanti
4,647,042 A * 3/1987 Bruce ..... 473/430
4,674,744 A 6/1987 Walsh
4,706,964 A 11/1987 Genovese
4,830,372 A 5/1989 Outlaw et al.
4,898,385 A 2/1990 Love
4,986,551 A 1/1991 Langlois et al.
5,048,828 A 9/1991 Love
5,098,094 A 3/1992 Kita
5,184,816 A 2/1993 Lunsford
5,228,683 A 7/1993 Beimel
5,255,920 A 10/1993 Mangeri
5,271,618 A 12/1993 Malwitz
5,273,277 A 12/1993 Freese
5,282,615 A 2/1994 Green et al.
5,338,026 A 8/1994 Kregel
5,374,056 A 12/1994 Scher et al.
5,454,561 A 10/1995 Smith
5,480,141 A 1/1996 Wood
5,531,438 A 7/1996 Corley
5,540,430 A 7/1996 Nichols et al.
5,577,964 A 11/1996 Chen
5,624,113 A 4/1997 Rabine
5,665,017 A 9/1997 Walters
5,681,168 A 10/1997 Brown
5,683,315 A 11/1997 Ring
5,700,203 A 12/1997 Shieh
5,713,805 A 2/1998 Scher et al.
5,743,820 A 4/1998 Espinosa et al.
5,746,667 A * 5/1998 Fraser et al. ..... 473/393
5,755,630 A 5/1998 Malwitz
5,779,568 A 7/1998 Turner et al.
5,803,836 A 9/1998 Beintema
5,833,555 A 11/1998 Jer-Min
5,836,836 A 11/1998 Grimes
5,865,683 A 2/1999 Yang
5,882,270 A 3/1999 Daugherty
5,957,789 A * 9/1999 Ainscough et al. ..... 473/423
6,129,637 A 10/2000 Wang et al.
6,334,821 B1 * 1/2002 Kita ..... 473/430
6,790,150 B1 * 9/2004 Moss et al. ..... 473/430

FOREIGN PATENT DOCUMENTS

GB 240652 10/1925
HU 194059 1/1988
HU 196912 2/1989
HU 200947 9/1990

* cited by examiner

FIG.9
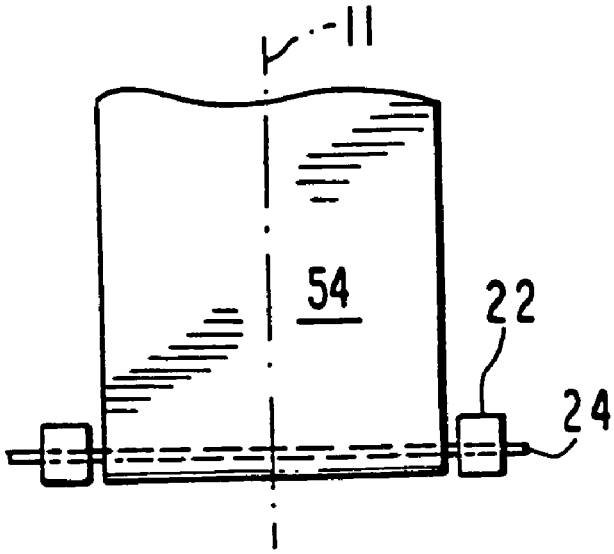
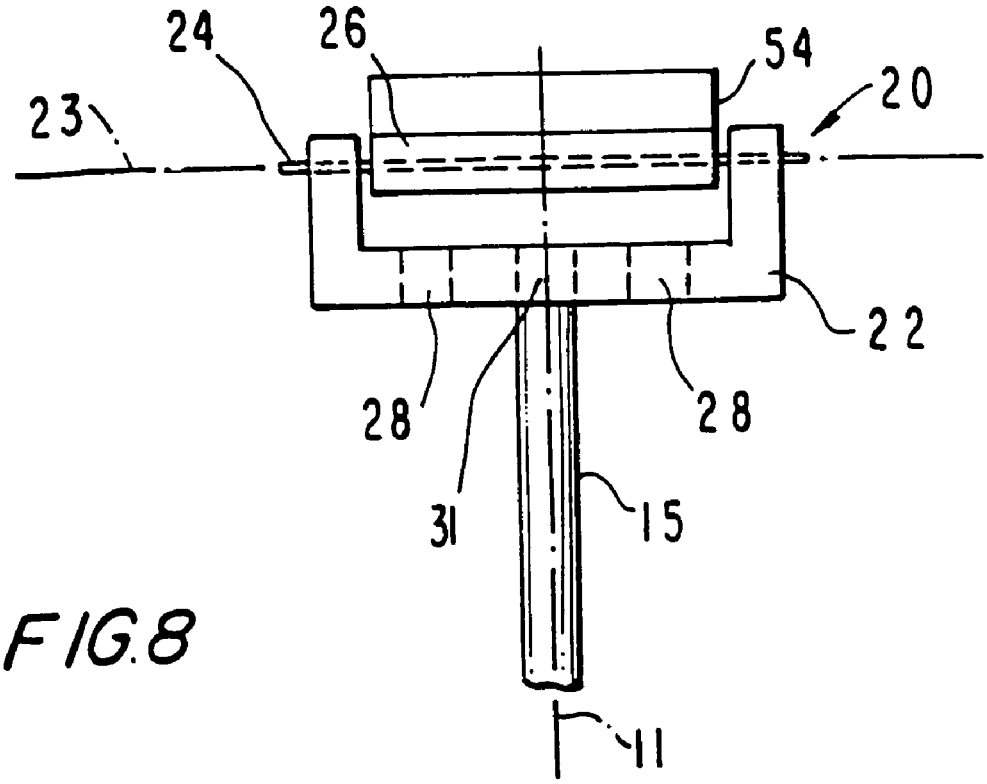
FIG.8

BALL HITTING PRACTICE APPARATUS

CROSS REFERENCE TO RELATED APPLICATIONS

This is a continuation of U.S. patent application Ser. No. 10/804,251, filed Mar. 19, 2004 now abandoned, which is a continuation of U.S. patent application Ser. No. 09/627,146, filed Jul. 27, 2000, now U.S. Pat. No. 6,790,150, which claims the benefit of U.S. provisional patent application No. 60/147,747, filed Aug. 6, 1999, all of which are hereby incorporated by reference herein in their entireties.

BACKGROUND OF THE INVENTION

Ball hitting practice devices that suspend balls from ropes mounted to horizontal support members are known. For example, Malwitz U.S. Pat. No. 5,271,618 shows a batting practice device that includes a horizontally extending metal pipe from which a ball is suspended with a rope. The rope passes through a central aperture of the ball. A knot is formed at the end of the rope that holds the ball on the rope. In another example, Rabine U.S. Pat. No. 5,624,113 shows a portable batting system that can be attached to a chain link fence. Additional systems that suspend balls from ropes mounted to horizontal support members are shown, for example, in Lunsford U.S. Pat. No. 5,184,816, Smith U.S. Pat. No. 5,454,561, Ring U.S. Pat. No. 5,683,315, Espinosa et al. U.S. Pat. No. 5,743,820, and Grimes U.S. Pat. No. 5,836,836.

In each of the above-identified systems, however, it is difficult to cause the ball, which is suspended at the end of a flexible rope, to consistently pass through or over the same area.

Other known ball practice devices attach balls to rigid members. For example, U.S. Pat. No. 5,833,555 shows a gravitationally restored ball practice device and Shieh U.S. Pat. No. 5,700,203 shows a golf training device that uses a "dummy ball assembly." In these systems, although the ball is required to pass through the same path, the ball does not simulate the natural motion of a free or tethered ball.

Some known devices suspend balls from ropes and tubes. For example, Corley U.S. Pat. No. 5,531,438 shows a batting practice device that includes a ball tethered at the end of a rope and a soft plastic tube that covers a portion of the rope immediately above the ball. In another example, Kregel U.S. Pat. No. 5,338,026 shows a swing training unit that includes a tethered ball mounted beneath a basketball hoop. Although both references suspend a ball using a rope and a tube, the ball does not consistently move through the same or similar path.

Finally, Scher et al. U.S. Pat. No. 5,374,056 shows a baseball practice device that suspends a ball from a "Y" shaped tether system that is itself supported by two horizontal arms that are also arranged in a "Y" shaped configuration. Unfortunately, the "Y" shaped tether system is visually distracting and mechanically complicated and the "Y" shaped arms can add substantial weight to the upper portion of the device, potentially destabilizing it.

It would therefore be desirable to provide a ball hitting practice device that is capable of consistently delivering a ball through the same or similar path.

It would also be desirable to provide a ball hitting practice device that is capable of consistently delivering a ball to a user in a smooth and natural manner.

It would further be desirable to provide a ball hitting practice device that is capable of consistently simulating a number of different types of pitches.

It would additionally be desirable to provide a stable ball hitting practice device that is simple to make and use.

It would still be more desirable to provide a ball hitting practice device that includes a ball mounting assembly, which can be releasable.

SUMMARY OF THE INVENTION

It is therefore an object of this invention to provide a ball hitting practice device that is capable of consistently delivering a ball through the same or similar path.

It is also an object of this invention to provide a ball hitting practice device that is capable of consistently delivering a ball to a user in a smooth and natural manner.

It is a further object of this invention to provide a ball hitting practice device that is capable of consistently simulating a number of different types of pitches.

It is yet another object of this invention to provide a stable ball hitting practice device that is simple to make and use and that is not visually distracting.

It is still another object of this invention to provide a ball hitting practice device that includes a ball mounting assembly that can be releasable.

In accordance with this invention, a ball hitting practice apparatus is provided that includes a substantially rigid member, a hinge, and a ball mounting assembly. The substantially rigid member has a first, upper end and a second, lower end. The hinge can be supported by a frame and the upper end of the substantially rigid member is fixed to the hinge such that the member can rotate about a substantially horizontal axis. The ball mounting assembly is suspended from the lower end of the substantially rigid member.

Methods for making and using the ball hitting practice apparatus are also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 8 is a front partial elevational view of the ball hitting practice apparatus shown in FIG. 2, taken from line 8—8 of FIG. 2 according to the present invention.

FIG. 9 is a top partial plan view of the ball hitting practice apparatus shown in FIG. 2, taken from line 9—9 of FIG. 2 according to the present invention.

DETAILED DESCRIPTION OF THE INVENTION

In order that the invention herein described may be fully understood, the following detailed description is set forth.

Figure 1:
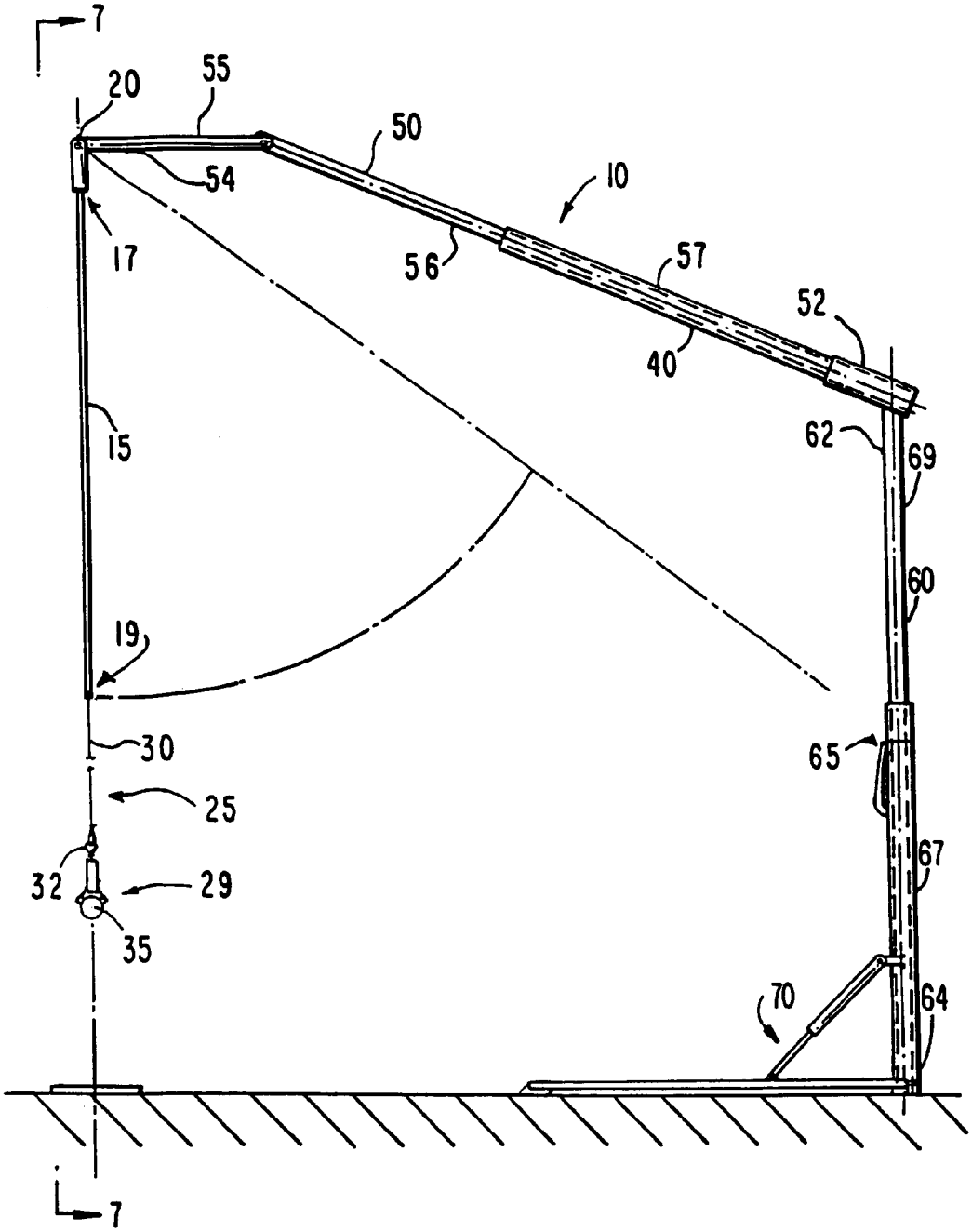
FIG. 1 is a side elevational view of an illustrative embodiment of a ball hitting practice apparatus according to the present invention.

FIG. 1 shows ball hitting practice apparatus 10 according to this invention. Apparatus 10 at least includes (1) substantially rigid member 15 having first end 17 and second end 19, (2) hinge 20 attached at or near first end 17 such that second end 19 rotates about a substantially horizontal axis, and (3) ball mounting assembly 25. Preferably, second end 19 rotates in a substantially vertical plane. Most preferably, member 15 is elongated and rotates in a substantially vertical plane. It will be appreciated that member 15 can also have a shape that is not elongated, such as an "L" shape, as long as that shape is capable of rotation about a substantially horizontal axis.

Ball mounting assembly 25 includes tether 30 and ball mounting device 29, which is suspended from tether 30. In one embodiment, member 15 is longer than assembly 25. As explained more fully below, ball 35 can be attached to assembly 25 in many different ways.

Figure 2:
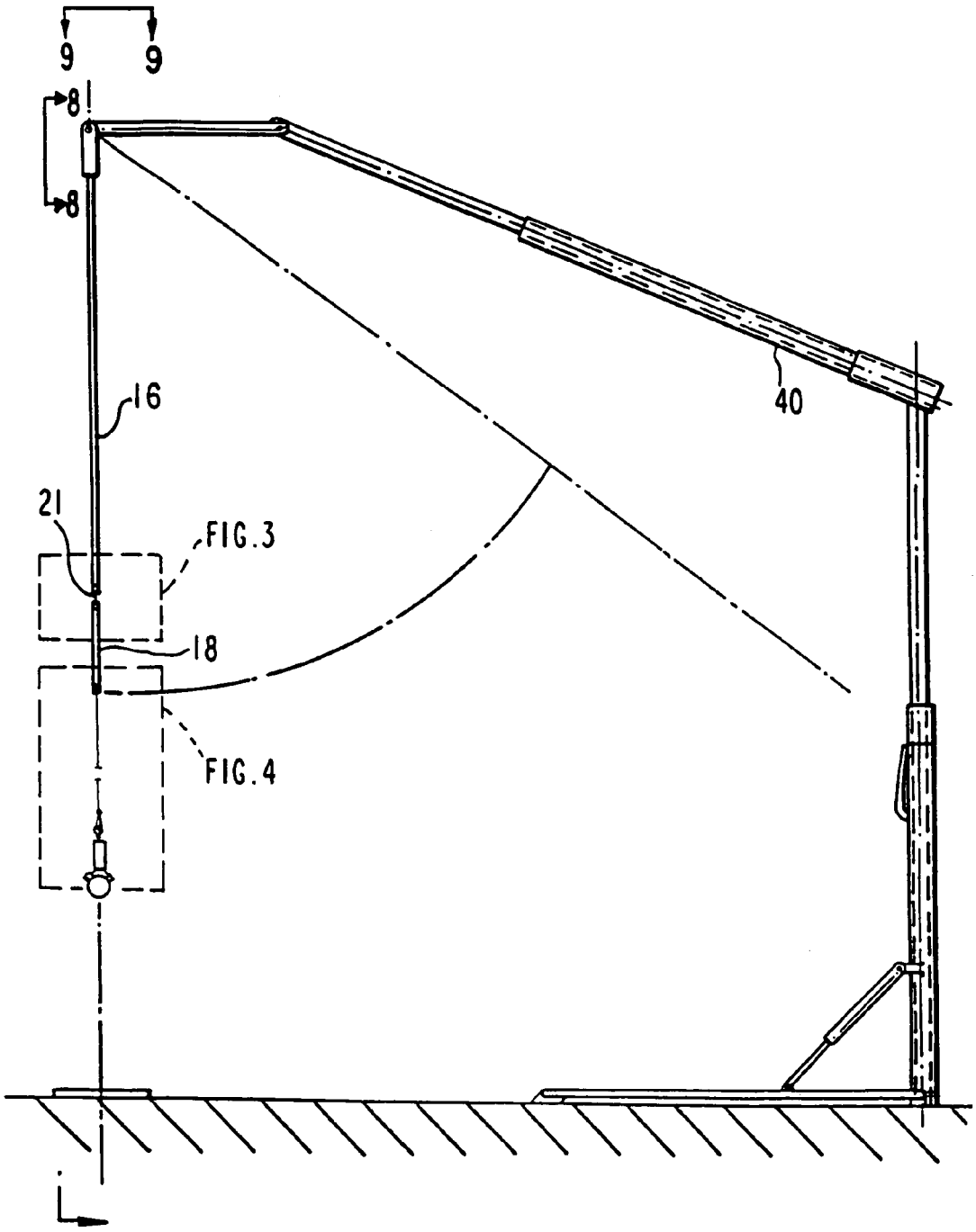
FIG. 2 is a side elevational view of another illustrative embodiment of a ball hitting practice apparatus according to the present invention.
Figure 3:
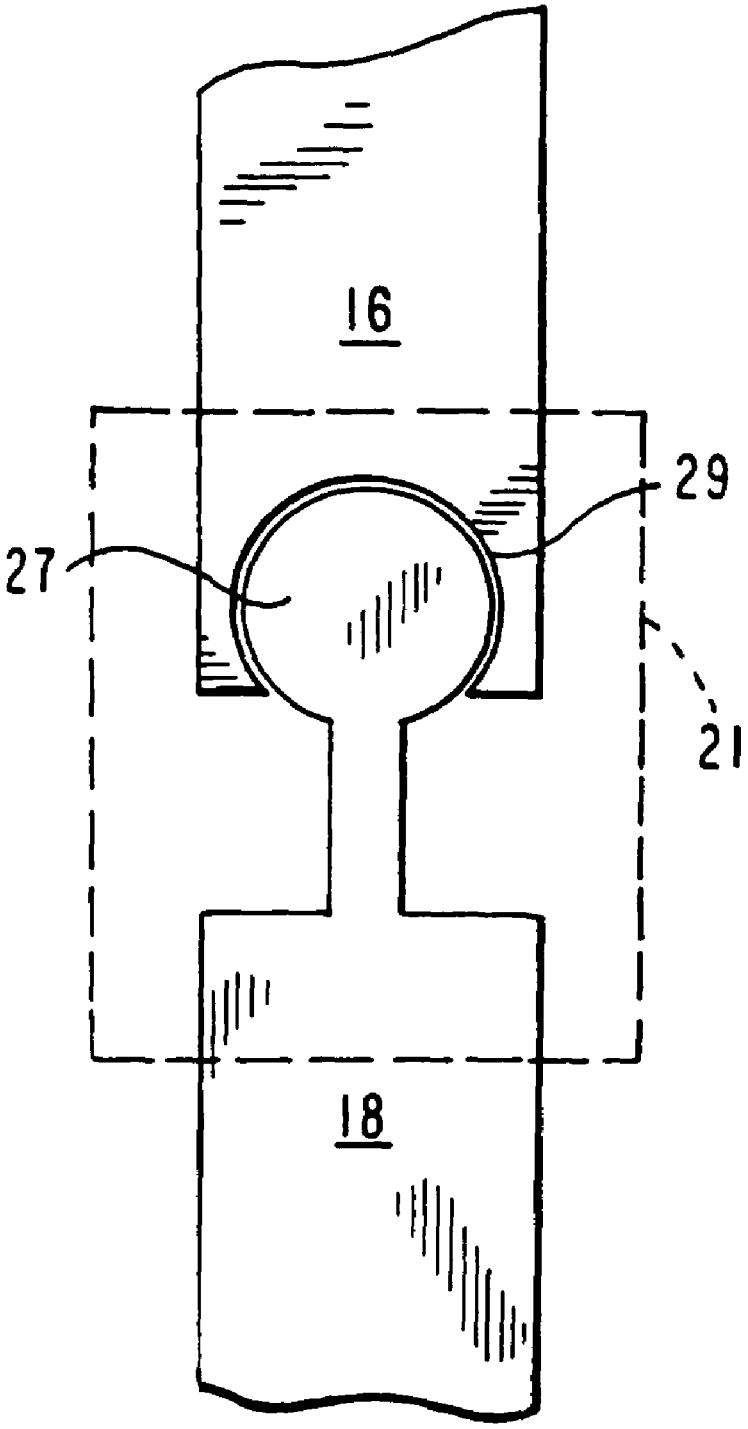
FIG. 3 is a cross-sectional, partial elevational view of the hinge region between two elongated portions that make up the substantially rigid member shown in FIG. 2 according to the present invention.

A number of measures can be taken to help ensure smooth and natural ball motion while a ball is attached to ball mounting device 25. For example, as shown in FIG. 2, the substantially rigid member can be made from two or more substantially rigid portions 16 and 18 connected by second hinge 21 so that each of portions 16 and 18 is capable of movement with respect to the other. In one embodiment, as shown in FIG. 3, second hinge 21 permits motion only in, or parallel with, the vertical plane already provided by hinge 20. In this case, hinge 21 can be a cylinder-and-socket type connector, which includes cylinder 27 and socket 29. Here, the cylinder only rotates about its longitudinal axis in the socket. This serves to restrict rotation of the lower portion to a substantially vertical plane. The lower and upper portions can also be connected with one or more hooks. In another embodiment, second hinge 21 is a ball-and-socket type connector that permits rotation in and out of the vertical plane defined by the first hinge.

Natural motion of the ball can also be improved when the substantially rigid member weighs less than the weight of the combination of the ball mounting assembly and a ball attached to the assembly. Preferably, the combination of the substantially rigid member, the ball mounting assembly, and the ball (when attached to the assembly) has a center of gravity that is below the substantially rigid member's lower end.

As shown in FIG. 1, for example, apparatus 10 can also include frame 40 for attaching hinge 20. In one embodiment, frame 40 includes substantially horizontal support structure 50 onto which hinge 20 is secured. Apparatus 10 can also include substantially vertical support structure 60 for supporting structure 50. Structure 60 has upper end 62 and lower end 64. In this case, end 52 of horizontal structure 50 can be secured at or near end 62 of vertical structure 60 and hinge 20 can be secured at or near end 54 of horizontal structure 50. Frame 40 can also include base 70 for supporting vertical structure 60.

It will be appreciated that any of substantially horizontal and substantially vertical structures 50 and 60 can be made from a single component, or from two or more components. It will be further appreciated that these components need not be oriented in the same direction. For example, as shown in FIG. 1, substantially horizontal support structure 50 actually includes components 55, 56, and 57.

Figure 3A:
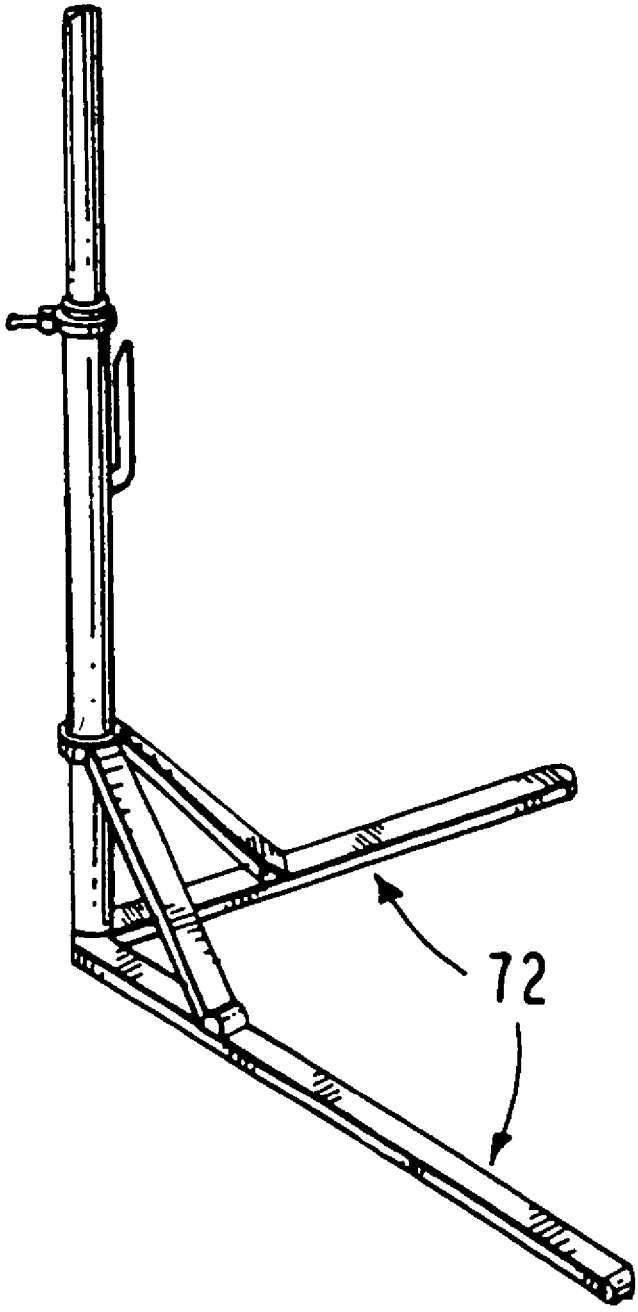
FIG. 3*a* is a perspective view of an illustrative base of a ball hitting practice apparatus according to this invention.

Base 70 can be located in or near the substantially vertical plane of rotation. As shown in FIG. 3*a*, for example, base 70 can include two or more legs 72 (which may be collapsible). When used for baseball practice, base 70 can be placed behind home plate so that apparatus 10 can be used easily by both left and right handed hitters. Other types of bases can also be used, including water or sand filled bases.

Figure 3B:
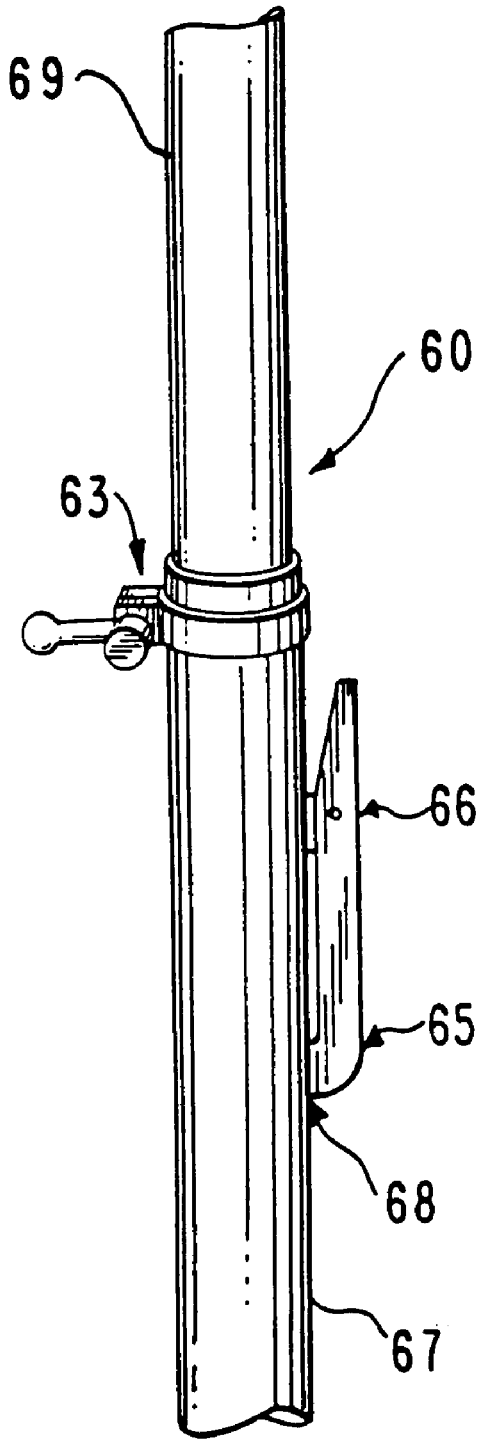
FIG. 3*b* is a side elevational view of an illustrative vertical support structure and a mechanism for adjusting its length according to this invention.

Both support structures 50 and 60 can have adjustable lengths to accommodate different user heights. As shown in FIG. 1, for example, these structures can be telescopically connected. Locking hardware, such as pins and/or mechanical belts or collars, can be used to secure the lengths of the telescopic structures. As shown in FIG. 3*b*, for example, vertical support structure 60 includes locking structure 65, which rotates about pivot 66 and is insertable through outer component 67 via aperture 68 for engaging inner component 69. Adjustable collar 63 can also be used to tighten the coupling between inner and outer structural components 67 and 69 for the purpose of preventing wobble therebetween.

Ball mounting assembly 25 includes ball mounting device 29, but can additionally include one or more components, such as tether 30. Tether 30 could have an adjustable length, using a variable length loop, adjustable with any convenient fixing means, including a cord latch or simply knot 32. Ball mounting assembly 25 is suspended from lower end 19 of member 15.

Figure 4:
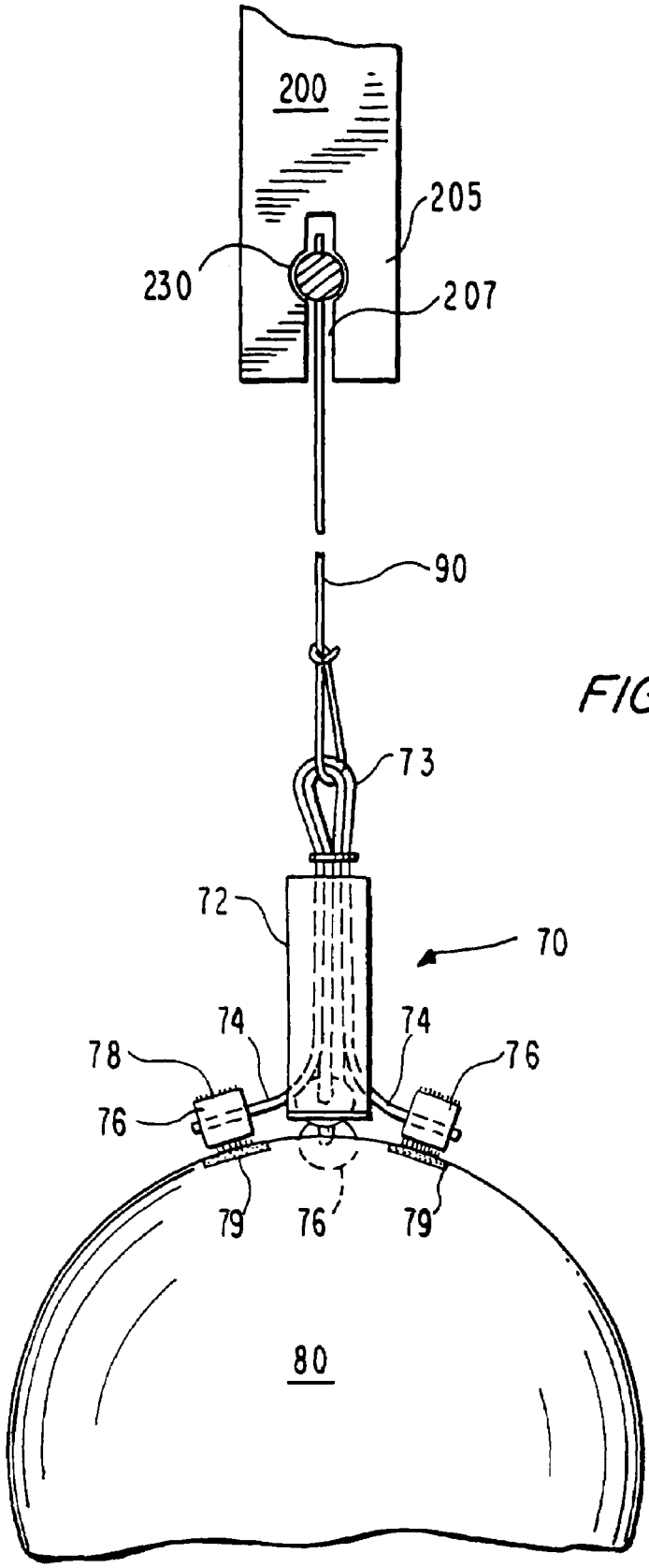
FIG. 4 is an elevational view of an illustrative embodiment of a ball mounting assembly (front view) and the lower end of the rigid member (side view), from which the assembly is suspended according to the present invention. This view corresponds to the portion enclosed by a dashed box shown FIG. 2.

FIG. 4 shows illustrative ball mounting device 70, which includes vertically suspended tube 72, plurality of shafts 74 that extend somewhat horizontally, and plurality of tubular members 76, which are supported by shafts 74. Preferably, members 76 are adapted to rotate around each of shafts 74. Tubular members 76 can allow for releasable mounting of ball 80. Shafts 74 can be made from any material that is sufficiently stiff to support tubular member 76. Preferably, shafts 74 allow rotation of tubular member 76, such as a rope (e.g., made from nylon) or a rod. As shown in FIG. 4, the same rope can be inserted through tube 72 to form loop 73 for attachment to tether 90.

To facilitate releasable mounting of ball 80, a releasable fastener can be used between device 70 and ball 80. The fastener can include two complementary halves 78 and 79. First half 78 is fixed to tubular member 76 and second half 79 is fixed to ball 80. One fastener of this type is a hook-and-loop type fastener (commonly referred to as VELCRO®), with the hook portion preferably attached to device 70 and the loop portion attached to ball 80. A portion of tubular member 76 can be made concave for increasing contact surface between the two fastener halves. Preferably, tubular member 76 or any other part of device 70 (including entire device 70) can be replaceable.

Figure 5:
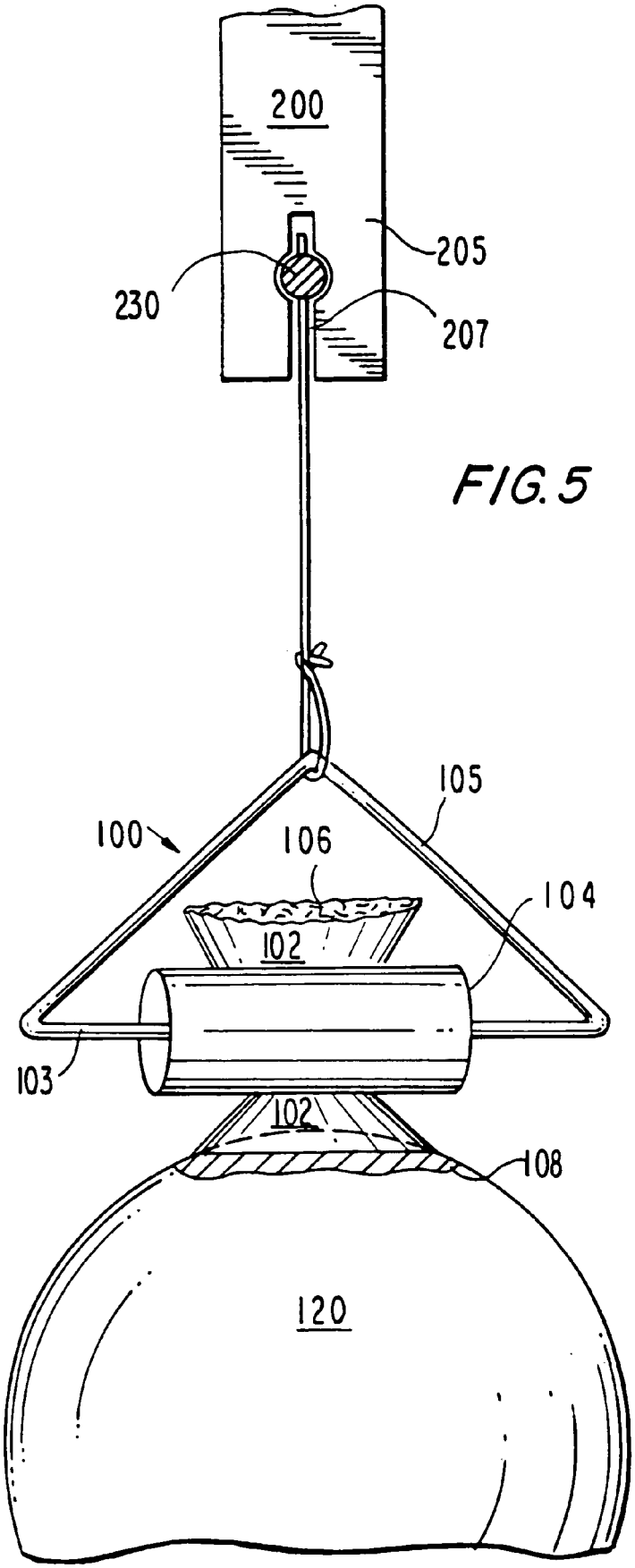
FIG. 5 is an elevational view of another illustrative embodiment of a ball mounting assembly (front view) and the lower end of the rigid member (side view), from which the assembly is suspended according to the present invention.

FIG. 5 shows another illustrative releasable ball mounting device 100. Device 100 includes at least one cup 102 that is secured to tubular member 104. In this embodiment, cup 102 is used instead of a tubular member with a concave portion. Tubular member 104 can be suspended by substantially horizontal shaft 103, which can be part of a larger support structure, such as triangular structure 105. Structure 105 need not be triangular, but should be capable of suspending member 104, preferably in a substantially horizontal manner. Tubular member 104 can optionally be rotatable about shaft 103.

Cup 102 preferably has an inner radius of curvature that substantially matches the outer radius of curvature of ball 120. The concave shape of cup 102 serves to increase contact surface area with ball 120. A releasable fastener is used to facilitate attachment of cup 102 to ball 120. Preferably, the fastener has two halves. First half 106 is fixed to inner surface of cup 102 and second half 108 is fixed to ball 120. One fastener of this type is a hook-and-loop type fastener (i.e., VELCRO®), with the hook portion preferably attached to device cup 102 and the loop portion attached to ball 120.

It will be appreciated that a releasable fastener need not be provided on the inside of cup 102 and to the surface of ball 120. Rather, cup 102 can be releasably attached to ball 120 using suction. In this case, cup 102 preferably attaches to a substantially smooth surface of ball 120. When suction is formed between the cup and the ball, the ball will be held in place. When the ball is hit, the suction is terminated and the ball is released.

Figure 6:
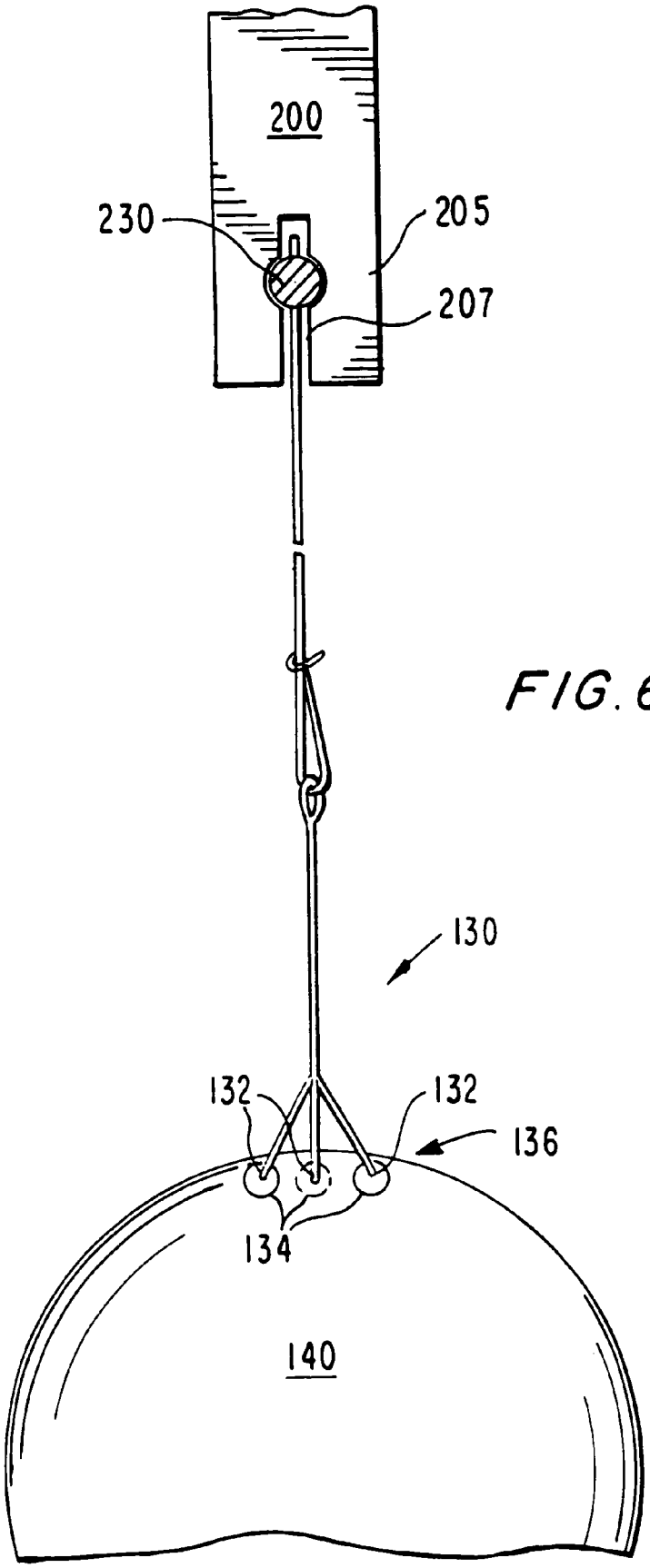
FIG. 6 is an elevational view of yet another illustrative embodiment of a ball mounting assembly (front view) and the lower end of the rigid member (side view), from which the assembly is suspended according to the present invention.

FIG. 6 shows another type of ball mounting device that includes a different type of releasable fastener. Ball mounting device 130 includes a releasable fastener that itself includes piercing half 132 and pierceable half 134. Piercing half 132 is preferably attached to lower end 136 of ball mounting device 130 and pierceable half 134 to ball 140. Piercing half 132, which is buried in pierceable half 134 in FIG. 6, includes at least one pointed member (e.g. a spike). Pierceable half is preferably made from a penetrable material, such as rubber, that can withstand multiple pierces. When the spike pierces the rubber, it will be held there until the ball is hit by a hitting device, such as a bat. It will be appreciated that the piercing half need not be used with a shaft and rotatable tubular member as described above. Rather, the piercing half need only be suspended from the ball mounting device, such as shown in FIG. 6.

A substantially rigid member according to this invention can be a rod made from a material that is preferably lightweight, substantially rigid, and/or soft. Materials that can be used to construct the substantially rigid member include, for example, foam, aluminum, plastic, rubber, or the like. Moreover, a combination of such materials can also be used. For example, the substantially rigid member may include an aluminum rod surrounded by foam, rubber, or any other soft material to prevent injury. Also, the substantially rigid member can have a length that is adjustable.

Figure 7:
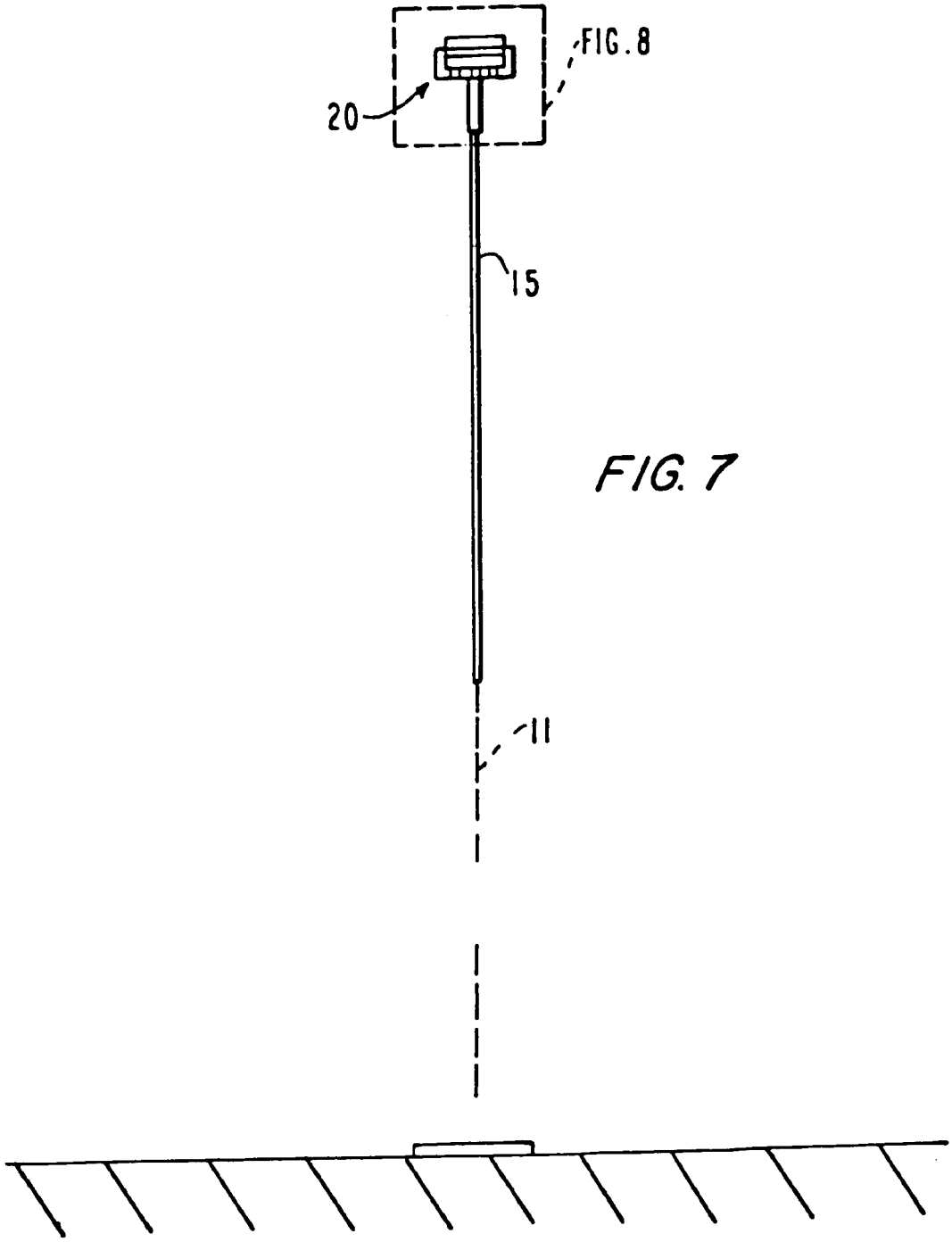
FIG. 7 is an enlarged partial front elevational view of the ball hitting practice apparatus shown in FIG. 1, taken from line 7—7 of FIG. 1 according to the present invention.

FIG. 7 is an enlarged partial front elevational view of ball hitting practice apparatus 10, showing, in particular, hinge 20. Hinge 20 is preferably fixed near end 54 of horizontal structure 50 and to upper end 17 of member 15 such that member 15 is guided in substantially vertical plane 11. As shown best in FIG. 8, hinge 20 can include pin 24 (shaft-like member) having substantially horizontal longitudinal axis 23 about which bottom part 22 can rotate. This ensures that member 15, which is attached to bottom part 22, rotates substantially in vertical plane 11. Upper part 26 can either be integrated with structure 50 or secured thereto. FIG. 9 also shows hinge 20 and structure 50 from above. It will be appreciated that hinge 20 can be anything that substantially limits rotation of member 15 about a substantially horizontal axis.

Hinge 20 can be constructed to provide member 15 limited motion out of vertical plane 11 as well. For example, a spring element (not shown) can be attached between hinge 20 and member 15 or within bottom part 22 itself. Such out-of-plane motion may be desirable to prevent injury if a person bumps into member 15 in a direction that is out of vertical plane 11.

Also, hinge 20 is preferably lightweight. Thus, hinge 20 should be small and preferably made with a lightweight material, such as plastic. To reduce the weight of hinge 20 further, passages can be molded into or bored from any part of hinge 20. For example, bottom part 22 include passages 28. As shown best in FIG. 8, member 15 can be inserted into one of passages 28 and secured with set screw 31 or the like.

Figure 10:
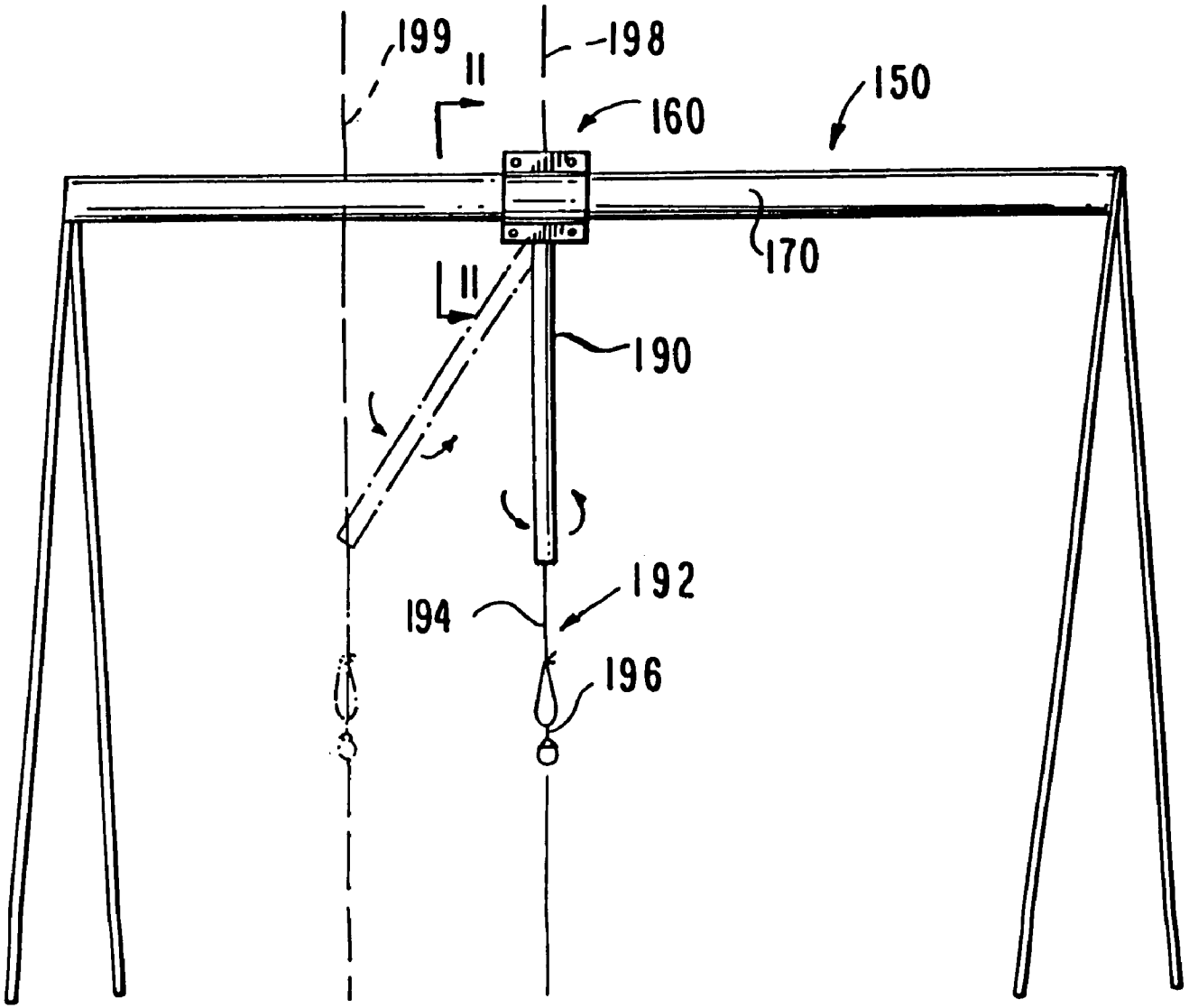
FIG. 10 is a perspective view of yet another illustrative embodiment of a ball hitting practice apparatus according to the present invention.
Figure 11:
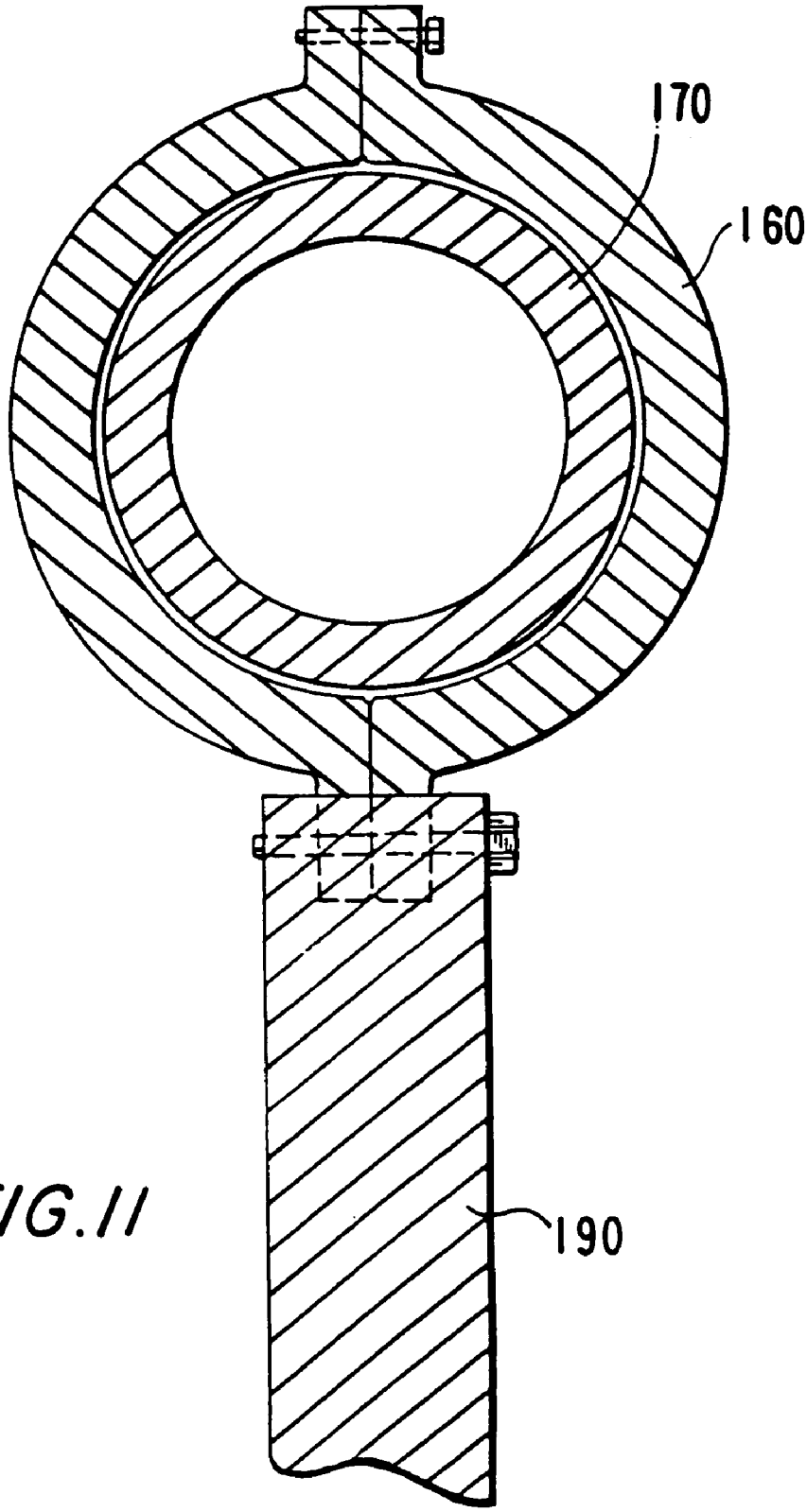
FIG. 11 is a side cross-sectional view of the ball hitting practice apparatus shown in FIG. 10, taken from line 11—11 of FIG. 10 according to the present invention.

FIG. 10 shows another embodiment of a ball hitting practice apparatus according to this invention. Apparatus 150 includes a different type of hinge than the one shown in FIG. 1. In this case, horizontal support structure 170 (e.g., a horizontal bar of a children's swing set) acts as one half of the hinge and collar 180, to which member 190 is attached, is rotatably mounted on horizontal support structure 170. FIG. 11 shows a magnified side view of the region surrounding hinge 160.

As already described above, apparatus 150 also includes ball mounting assembly 192, which includes tether 194 and ball mounting device 196. Tether can be any elongated flexible component that is suspendable from the bottom of member 190, from which ball mounting device 196 can be suspended. In one embodiment, tether 194 is adjustable in length and can be made from an elastic or inelastic string or rope.

As shown in FIG. 10, member 190 rotates in substantially vertical plane 198. It will be appreciated, however, that only the lower end of member 190 (where ball mounting assembly 192 is attached) can rotate in a vertical plane. For example, as shown in dashed relief in FIG. 10, member 190 can be mounted to hinge 160 at an angle. In this case, only the lower end of member 190 rotates in substantially vertical plane 199. It will be appreciated that any substantially rigid member according to this invention can be mounted in a similar fashion.

A ball mounting assembly according to this invention can be of the releasable type. As shown in FIGS. 4–6, for example, a ball mounting assembly can include a tether suspended from the lower split end of the substantially rigid member and a ball mounting device suspended from the tether. As also shown by these FIGS., the tether can have an upper end with a releasable object, such as a bead, attached thereto. The lower split end of the rigid member can have a longitudinal passage adapted to hold the object until the tether has a tension greater than a threshold tension. When the threshold tension is reached, the object will slip through the passage.

Because the tether can detach from the substantially rigid member, the apparatus is safer than non-detachable practice devices. For example, if a batter swings into the tether and entangles his bat, the detachable feature ensures that the frame does not topple and that the batter does not otherwise injure himself.

It will be appreciated that the threshold tension is determined, at least in part, by the amount that the substantially rigid member must flex before the object can slip out. Thus, the threshold can be decreased by increasing the size of the passage, the rigidity of the substantially rigid member, or decreasing the friction between the object and the passage.

As also shown in FIGS. 4–6, split end 205 can be formed by forming longitudinal slot 207 at the end of a standard tube. Alternatively, split end 205, or entire rigid member 200, can be formed using any conventional molding technique. Longitudinal slot 207 preferably has a thickness that is less than the diameter of bead 230 to prevent bead 230 from falling out from end 205. The upper end of longitudinal slot 207, however, has a thickness that is greater than the diameter of bead 230 to allow manual insertion or removal of bead 230 from end 205.

Figure 12:
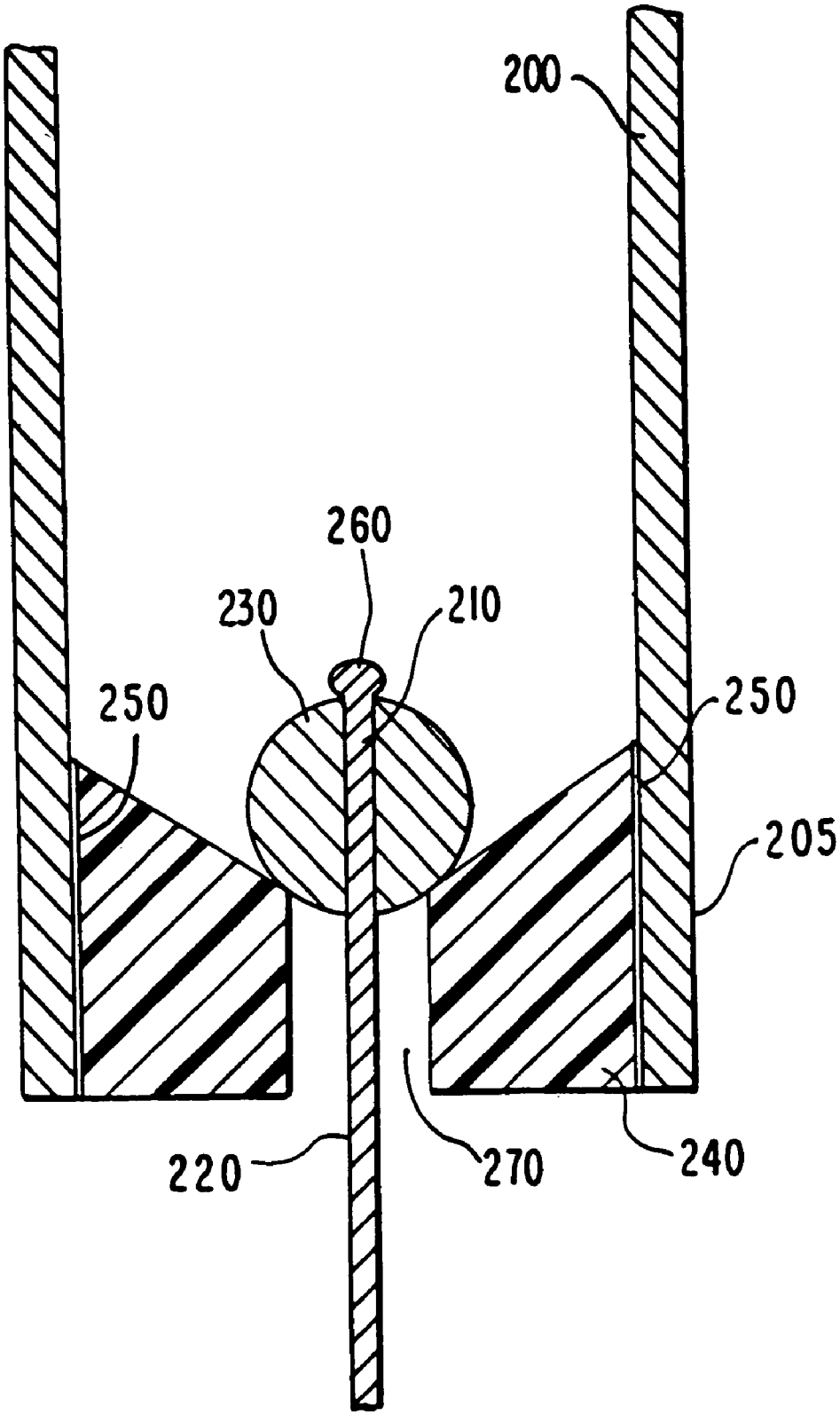
FIG. 12 is a cross-sectional view of an illustrative lower end of a substantially rigid member according to this invention.

FIG. 12 shows a cross-sectional view of illustrative lower end 205 of substantially rigid member 200 with hollow plug 240 attached to end 205 and upper end 210 of tether 220 with bead 230 attached to end 210. As described above, member 200 can be made from a material such as foam, aluminum, plastic, rubber, or the like. Hollow plug 240 can also be made from any of these materials. One suitable plastic material is sold by E.I. Du Pont de Nemours and Company, of Wilmington, Del., under the trademark DELRIN®.

Plug 240 can be attached to end 205 by any convenient means, including glue 250 or a set screw (not shown). As shown in FIG. 12, the upper surface of plug 240 is sloped to center bead 230 at the upper end of bead passage 270. It will be appreciated that plug 240 is two unattached semi-annular pieces, each of which is attached to opposite inner surfaces of end 205. Because these pieces are unattached, they can separate when bead 230 is pulled in a downward direction from the position shown in FIG. 12.

Bead 230 can be fixed to upper end 210 of tether 220 by threading end 210 through bead 230 as shown in FIG. 12. Alternatively, bead 230 and tether 220 can be formed from a single material. It will be appreciated, however, that tether 220 could be suspended with any object, including a non-spherical object. When bead 230 is used, tip 260 of tether 220 is preferably thick enough such that tip 260 does not slip through bead 230, even when tension is applied to tether 220.

It will be appreciated that member 200 can be integral with tether 220. For example, member 200 and tether 220 can be made from a rope, where the upper portion that forms member 200 is hardened. For example, a nylon rope can be hardened by coating it or impregnated with a resin (or by heating it), while the lower portion is left flexible. In this way, the hinge between member 200 and tether 220 is simply the transitional region therebetween. In this case, member 200 and tether 220 may not be detachable.

A method for practicing hitting a ball is also provided. The method includes providing a ball hitting practice apparatus that includes a ball mounting device, mounting a ball on the ball mounting device, positioning the ball at a preferred height, allowing the ball to fall while attached to the ball mounting device, and hitting the ball with a hitting device. The ball hitting practice apparatus can be any of the embodiments shown or discussed above. Preferably, when the ball is hit with sufficient force, the ball will detach from the ball mounting device as also discussed above. Hitting devices that can be used according to this invention include, but are not limited to, a bat, a club, a racket, a stick, a bare hand, and a gloved hand.

The ball should be positioned correctly during use of the apparatus. For example, when the ball is positioned correctly, the ball should be able to fall, causing the substantially rigid member to rotate on a hinge about a substantially horizontal axis. As explained above, the lower end of the member preferably moves in a substantially vertical plane.

In one embodiment, the ball can be positioned by raising the ball to a user-determined height. When the height is substantially above the lowest point along its path, the ball can fall under the force of gravity and pass that point (e.g., directly above or in front of home plate) along its arc at a high speed. When the ball is not raised to a lower height, the ball will pass that point at a lower speed. In this way, the speed of the ball passing the lowest point on the ball's arc can be adjusted. It will be appreciated that the ball can also be raised with an automated device, driven by an electric motor, or by any number of non-automated devices.

An advantage of the present invention is that a ball attached to the ball mounting device can be made to travel in a substantially consistent fashion—in or out of the vertical plane, but limited by the path of the substantially rigid member, which is preferably elongated. For example, if the ball is raised to a height in the vertical plane of the apparatus and then dropped, the motion of the ball during its swing will be primarily in-plane. However, if the ball is raised to the same position and then pushed in a direction that is out-of-plane, the motion of the ball will include out-of-plane motion. Alternatively, the ball can also be raised and released at a position outside the vertical plane. Thus, it will be appreciated that when the apparatus is used to practice hitting a baseball, a number of different types of pitches (e.g., curve, outside, inside, etc.) can be simulated consistently with the apparatus.

The combination of the substantially rigid member and the upper hinge is believed to be at least partially responsible for the ability of the apparatus to provide consistent yet variable simulations. This appears to be especially true when the substantially rigid member is longer than the ball mounting assembly.

When at least one of the substantially vertical and horizontal support structures has a length that is adjustable, the method can further include adjusting that length to adapt the apparatus to the practicing hitter. Similarly, when the ball mounting assembly includes a ball mounting device and a tether with an adjustable length, the method can further include adjusting the tether to a length to suit the practicing hitter.

Thus, it is seen that apparatus and methods are provided that can be used to practice hitting a ball. One skilled in the art will appreciate that the present invention can be practiced by other than the described embodiments, which are presented for purposes of illustration only and not by way of limitation, and the present invention is limited only by the claims that follow.

What is claimed is:

1. A releasable ball mounting apparatus, comprising:

a ball mounting device comprising:

first and second shafts;

first and second releasable fasteners, wherein the first releasable fastener is coupled to the first shaft and the second releasable fastener is coupled to the second shaft, wherein each of the first and the second releasable fasteners comprises two complementary halves, a first of the halves being coupled to its respective shaft and a second of the halves being fixed to the ball, and wherein the first and the second releasable fasteners are configured for releasable mounting of a ball.

2. The apparatus of claim 1 wherein the first and the second releasable fasteners comprise a hook and loop type fastener.

3. The apparatus of claim 1 wherein the first and the second releasable fasteners comprise a piercing half and a pierceable half.

4. The apparatus of claim 3 wherein the piercing half comprises at least one pointed member and the pierceable half comprises rubber.

5. A releasable ball mounting apparatus, comprising:

a ball mounting device comprising:

first and second shafts; and first and second releasable fasteners, wherein the first releasable fastener is coupled to the first shaft and the second releasable fastener is coupled to the second shaft and wherein the first and the second releasable fasteners are configured for releasable mounting of a ball;

a tether from which the ball mounting device is suspended;

a substantially rigid member, wherein the tether is suspended from a first end of the substantially rigid member and wherein the tether is releasable from the substantially rigid member; and an object attached to the tether, wherein the first end of the substantially rigid member has a passage configured to hold the object until the tether has a tension greater than a threshold tension.

6. A releasable ball mounting apparatus, comprising:

a ball mounting device comprising:

first and second shafts;

first and second releasable fasteners, wherein the first releasable fastener is coupled to the first shaft and the second releasable fastener is coupled to the second shaft and wherein the first and the second releasable fasteners are configured for releasable mounting of a ball; and first and second tubular members configured to rotate around the first and the second shafts, respectively, wherein the first and the second releasable fasteners are coupled to the first and the second shafts via the first and the second tubular members.

* * * * *